United States Patent [19]

Correard

[11] Patent Number: 4,795,094

[45] Date of Patent: Jan. 3, 1989

[54] APPARATUS FOR SPRAYING A POWDER COATING WITH ENCLOSURE SURROUNDING A VIBRATING HOSE

[75] Inventor: Jean-Yves Correard, Saint Martin D'Heres, France

[73] Assignee: SAMES S.A., Meylan, France

[21] Appl. No.: 899,802

[22] Filed: Aug. 25, 1986

[30] Foreign Application Priority Data

Sep. 4, 1985 [FR] France ..... 85 13123

[51] Int. Cl.[4] ..... B05B 7/04

[52] U.S. Cl. ..... 239/229; 239/263; 239/433; 239/526; 239/600; 118/308; 118/612; 427/421; 336/126; 222/195; 222/630

[58] Field of Search ..... 239/142, 144, 340, 346, 239/433, 434, 526, 4, 11, 229, 102.1, 225.1, 600, 525, 263; 118/308, 612, DIG. 5; 427/421; 222/195, 630; 366/124, 125, 126

[56] References Cited

U.S. PATENT DOCUMENTS

| | | | |
|---|---|---|---|
| 699,838 | 5/1902 | Evans | 51/427 X |
| 2,675,777 | 4/1954 | Lachaise | 116/137 |
| 3,108,749 | 10/1963 | Drayer et al. | 4/239 |
| 3,123,302 | 3/1964 | Drayer | 239/102.1 X |
| 3,374,953 | 3/1968 | Bodine | 366/126 X |
| 3,474,967 | 10/1969 | Bodine | 239/102.1 X |
| 3,563,421 | 2/1971 | Coates et al. | 222/196 |
| 3,740,260 | 6/1973 | Winn | 117/104 R |
| 3,925,580 | 12/1975 | Brewer | 427/421 X |
| 4,067,150 | 1/1978 | Merrigan | 239/142 X |
| 4,438,884 | 3/1984 | O'Brien et al. | 239/600 |
| 4,540,120 | 9/1985 | Waszkiewicz | 239/1 |

FOREIGN PATENT DOCUMENTS

| | | |
|---|---|---|
| 0131805 | 1/1985 | European Pat. Off. . |
| 2541911 | 9/1984 | France . |

*Primary Examiner*—Shrive Beck
*Assistant Examiner*—Alain Bashore
*Attorney, Agent, or Firm*—Sandler & Greenblum

[57] ABSTRACT

A powder product to be sprayed is conveyed by a stream of gas in a flexible conduit between a storage tank and a spray orifice from which a mixture of the gas and the product is ejected. The mixture is agitated upstream of and in the vicinity of this orifice by oscillating a section of the flexible conduit in the vicinity of this orifice. The powder product sprayer comprises a flexible conduit and a device for circulating a mixture of the product and the gas in this conduit. It further comprises an enclosure surrounding a section of the conduit and a device for oscillating this section of the conduit. The device for oscillating the conduit may comprise a vibrator fixed to this section of the conduit and free to move inside the enclosure. The vibrator may comprise an annular cage surrounding and fixed to this section of the conduit, a ball movable inside the cage and a device for injecting air into the cage in a direction adapted to cause movement of the ball inside the cage. Alternatively, the device for oscillating the conduit may comprise an annular body attached to an inside wall of the enclosure with an annular cavity in this annular body. A device injects air into the cavity and holes in an inside lateral wall of the body discharge in a direction inclined towards the relevant section of the conduit, which passes axially through the annular body. The inside diameter of the annular body is greater than the diameter of the section of the conduit concerned.

16 Claims, 2 Drawing Sheets

APPARATUS FOR SPRAYING A POWDER COATING WITH ENCLOSURE SURROUNDING A VIBRATING HOSE

BACKGROUND OF THE INVENTION

1. Field of the Invention

The invention concerns a method of spraying a powder product and is more particularly concerned with improving the homogeneity of the powder jet. The invention also concerns a powder product sprayer implementing this method.

2. Description of the Prior Art

Powder spraying is a technique used in the most diverse industrial sectors, including: spraying of insecticide, spreading of mineral or organic additives over metal or plastics material parts during manufacture to modify their characteristics, spraying of additives onto the surface of foodstuffs products and spreading of heat-fusible powder paint over objects to be coated prior to passing them through an oven. All these applications, and in particular that last mentioned, require a relatively homogeneous jet of powder. The powder is generally taken from a storage tank in which it is maintained in a fluidized state by a flow of gas, in practise air, fed into the bottom part of the storage tank through a porous bottom wall. A calibrated gas jet fed into a venturi device accelerates and conveys the gas-powder product mixture through several meters of pipe to an ejector or sprayer device, often generally pistol-shaped to facilitate handling. In this type of installation the spraying of powder is sometimes inhomogeneous, which may be due to a number of factors and in particular the concentration of the mixture and the speed at which it circulates through the pipe. Firstly, the flow of the mixture is regular only over a certain range of flow velocities, in the order of 7 through 15 m/s. Below a specific lower speed limit the flow takes place in "packets" of powder. A low-speed flow also favors depositing of powder in the horizontal parts of the pipe and sprayer. Thus when the latter is held substantially horizontal by the user, which is usually the case, powder often accumulates within the casing of the sprayer, which favors inhomogeneous spraying and even partial clogging.

It is nevertheless advantageous to maintain a relatively low flow speed to obtain a relatively wide and slow jet, which reduces wear of the nozzle, avoids "blowing" the powder over the area to be covered and makes it possible to achieve better electrical charging of the particles when the sprayer is of the electrostatic type. Thus it is not possible to increase the speed at which the mixture circulates in the pipe without running into disadvantages. Finally, another cause of "defluidization" of the powder during its transfer from the storage tank to the sprayer (and thus of inhomogeneous spraying) is the centrifugal force created in bends in the pipe. This centrifugal force tends to separate the transporting gas and the powder so that powder accumulates on the outside of all bends. When the powder product sprayer is held horizontally, as already mentioned, the pipe connected to the rear of the sprayer forms a curve in a substantially vertical plane. The powder collects in the upper part of this bend, immediately behind the sprayer, and in many cases inhomogeneous spraying of powder results.

To combat all these phenomena it has already been proposed to place a deflector on the axis of the sprayer orifice, which also has the advantage of widening the powder jet, but the bridges linking this deflector to the end of the sprayer are a further source of inhomogeneous spraying. It has also been proposed to create a "vortex" type turbulent air jet in the vicinity of the sprayer orifice. The functioning of such systems relies primarily on the creation of turbulence in the powder jet. This speeds wear of the nozzle and results in significant head losses which limit the powder flowrate and favor wear.

The invention proposes to rehomogenize the mixture immediately before it is sprayed (that is, in the sprayer itself) by means of a process which does not have the disadvantages mentioned hereinabove.

SUMMARY OF THE INVENTION

In one aspect, the invention consists in a method of spraying a powder product in which said product is conveyed by a hose or stream of gas in a flexible conduit between a storage tank and a spray orifice from which a mixture of said gas and said product is ejected and said mixture is agitated upstream of and in the vicinity of said orifice by oscillating a section of said flexible conduit in the vicinity of said orifice.

In another aspect, the invention consists in a powder product sprayer comprising a flexible conduit, means for circulating a mixture of the product and a gas in said conduit, an enclosure surrounding a section of said conduit and means for oscillating said section of said conduit.

The means for oscillating the aforementioned section of the conduit may, for example, be a vibrator fastened to it or a "vortex" type air flow device adapted to impart an oscillatory movement to it.

The invention will emerge more clearly from the following description of various embodiments given by way of example only and with reference to the accompanying drawings.

DESCRIPTION OF THE PREFERRED EMBODIMENTS

Figure 1:
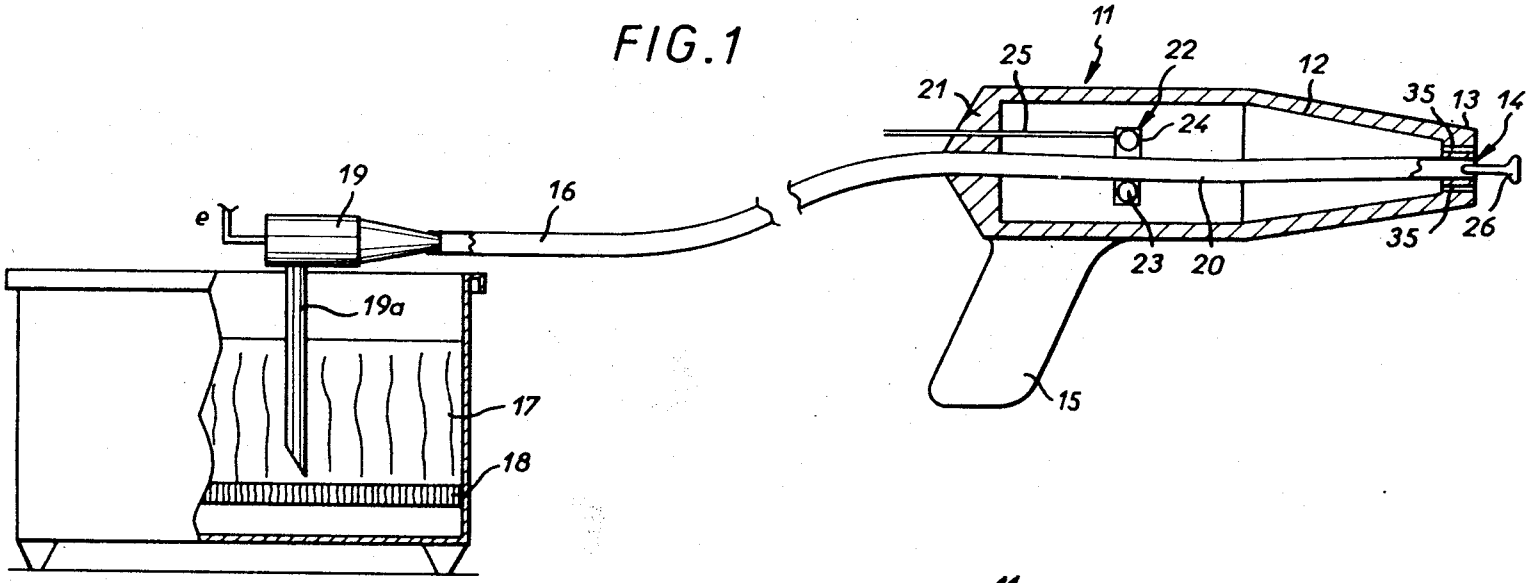
FIG. 1 shows a powder product spraying installation including a spayer in accordance with the invention.
Figure 2:
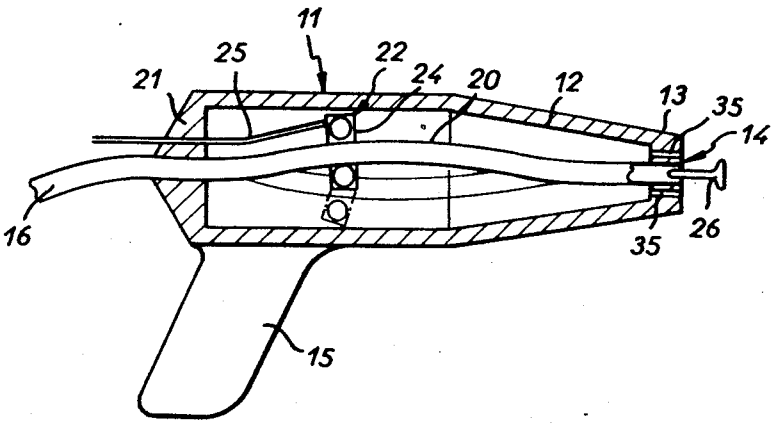
FIG. 2 shows how the sprayer of FIG. 1 operates.

Referring to FIGS. 1 and 2 in particular, there is shown a powder spraying installation comprising a powder product sprayer 11 including a casing 12 provided at its forward part with a nozzle 13 defining a spraying orifice 14. The casing is extended in its lower part by a handle 15 or by means for attaching it to a robot arm. A pipe 16 is attached to the rear end of the sprayer. It conveys an air-powder product mixture taken from a storage tank 17 in which said powder product is maintained in the fluidized stated by continuous injection of air into the lower part of the storage tank through a porous bottom wall 18 by means of a venturi device 19 inserted between the pipe 16 and a conduit 19*a* dipping into the storage tank. Compressed air is injected into the device 19 through an inlet e.

In accordance with the invention the casing 12 encloses means for agitating the mixture situated on the upstream side of the spraying orifice 14 and specifically consisting in this instance of a section 20 of flexible conduit connected to the means for creating and maintaining circulation of said mixture, as described hereinabove, and means for imparting oscillation to said section. In this example the section 20 of flexible conduit is merely formed by the terminal part of the pipe 16 which passes longitudinally through the casing 12 and is immobilized in fluid-tight manner at its two ends between the rear wall 21 of the casing and the nozzle 13. To obtain relatively large oscillations of the section 20, it is not stretched between its two fixed anchorage points (FIG. 1). The means for imparting oscillation to the section 20 here comprise a vibrator 22 fastened to the section 20 and freely movable within the casing 12. In this example the vibrator 22 is a pneumatic vibrator comprising a ball 23. It comprises an annular cage 26 surrounding the section and fixed to it. The ball 23 is able to move within the cage. An extremely flexible conduit 25 connected to a compressed air supply (not shown) discharges approximately tangentially into the cage so as to inject air into it in a direction adapted to cause the ball to move in said cage. This movement causes circular oscillation of the section 20 of flexible conduit and of the cage itself.

If the vibrations of the part 20 are of large amplitude any more highly concentrated streams of powder will follow trajectories induced by the movement, substantially tracing out helixes the pitch of which is defined by the operating conditions, notably the speed of the mixture and the rotation speed of the section of flexible conduit. The homogeneity of the jet at the outlet will be significantly improved as a result. If the vibrations are of low amplitude, the particles will be returned to suspension and, once again, improved homogeneity of the jet will result. As a general rule the two phenomena (deviation of the trajectory and return to suspension) coexist.

In this example the sprayer further comprises a deflector 26, known per se, axially aligned with the spraying orifice 14 and primarily intended to spread the jet to confer the necessary coverage.

Figure 4:
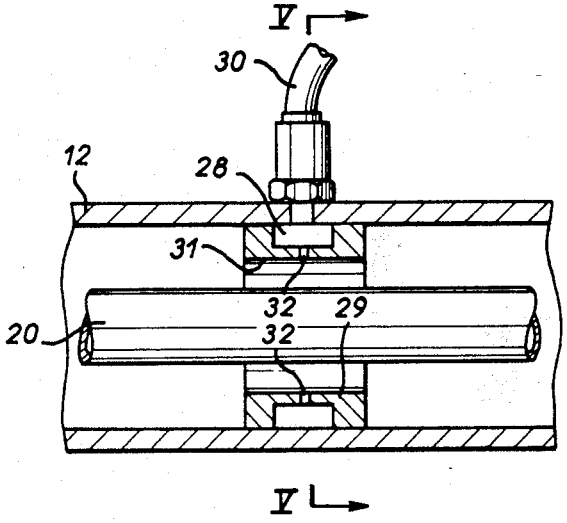
FIG. 4 is a detail view of another embodiment.
Figure 5:
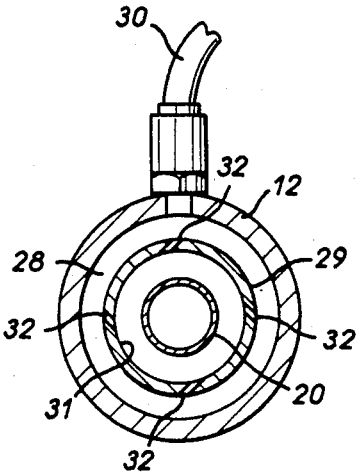
FIG. 5 is a cross-section on the line V—V in FIG. 4.

FIGS. 4 and 5 show alternative means for imparting oscillations to the section 20. Here the ball vibrator is replaced by an annular cavity 28 defined within an annular body 29 fixed to the inside wall of the casing. The section 20 of flexible conduit, whose outside diameter is significantly less than the inside diameter of the annular body 29, passes through the latter axially. The cavity 28 communicates through a pipe 30 with a compressed air supply (not shown). The internal lateral wall 31 of the body 29 is pierced by holes 32 that are regularly distributed in the circumferential direction in a plane and discharge in a direction inclined towards the section of flexible conduit. This arrangement gives rise to a vortex type turbulent flow of air leaving the cavity 28, causing circular oscillation of the section 20 in an analogous way to that of the FIG. 1 example. This arrangement has the advantage of making it possible to obtain a more compact casing for a given amplitude of oscillation of the flexible conduit section.

Note that in the case of the FIG. 1 embodiment, possibly modified in accordance with FIGS. 4 and 5, the air leaving the ball vibrator (or the annular cavity that has just been described) may be re-used to feed another arrangement adapted to define a vortex type turbulent flow but this time at the front of the casing, in the vicinity of the nozzle 13, for example by means of a set of holes 35 regularly distributed in the circumferential direction, tangential to a cylinder and inclined relative to the axis, that is to say in practise in the shape of portions of a helix, so as to permit the air to escape to the outside at the rear of the nozzle and create a turbulent flow of air contributing in the known way to homogenizing the jet of powder. The effectiveness of this arrangement is significantly improved because of the relative homogeneity of the mixture achieved by using the invention. The holes 35 may also be slightly inclined in the direction towards the axis of the powder jet.

Figure 3:
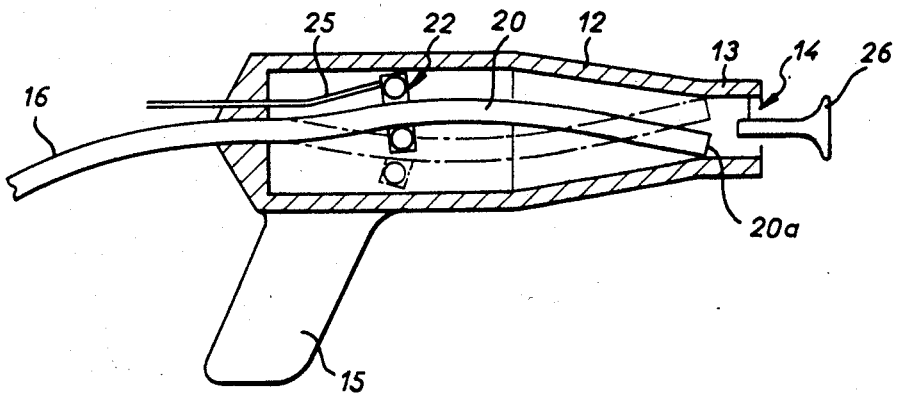
FIG. 3 shows a second embodiment of powder product sprayer in accordance with the invention, during operation.

FIG. 3 shows another embodiment in which analogous structural parts carry the same reference numbers. In this embodiment the nozzle 13 and consequently the spraying orifice 14 have a diameter larger than the outside diameter of the section 20 of flexible conduit and the end 20a of the latter is free to move in the vicinity of the orifice 14. In this case the means for imparting oscillations to the section 20 comprise the ball vibrator described with reference to FIG. 1, but it is obvious that this vibrator may be replaced with the arrangement of FIGS. 4 and 5. The cross-section of the nozzle 13 and of the spraying orifice 14 may be between twice and four times greater than that of the section 20. Operation is similar to that already described with reference to FIG. 1, with a jet of powder product which is more open by virtue of the movement of the free end of the section 20, as shown in FIG. 3. Note that the spraying orifice 14 does not necessarily have a circular contour. Its contour may be oblong and such that at least its larger transverse dimension is greater than the diameter of the section 20, this arrangement producing a flatter jet.

Figure 6:
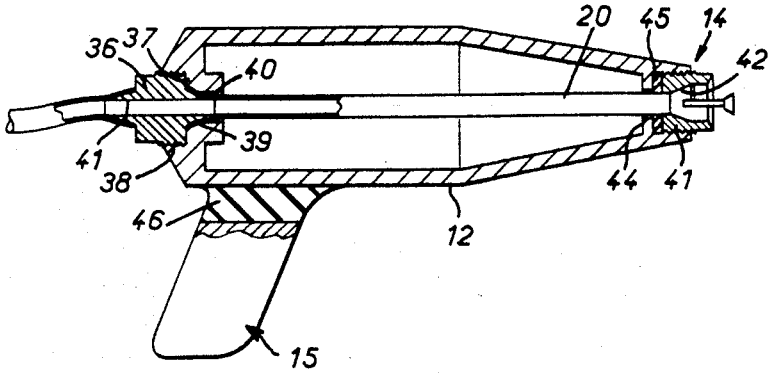
FIG. 6 shows a third embodiment of a powder product sprayer in accordance with the invention.

In the FIG. 6 embodiment, the means for imparting vibrations to the section 20 have not been shown but may, for example, comprise a mechanical vibrator analogous to that shown in FIG. 1 through 3 or a pneumatic system as shown in FIGS. 4 and 5. The sprayer is fitted with removable and interchangeable parts facilitating the mounting and demounting of the section 20, either for the purpose of replacing it when it is worn out or to enable it to be replaced with a part of different diameter, according to the order of magnitude of the flowrates required by the user.

Thus the sprayer comprises a connector 36 which is removable, accommodated in a cavity 37 in its rear wall. This connector has a threaded cylindrical outside part 38 screwed into a corresponding threaded portion of the cavity 37. The threaded part 38 is extended by a frustoconical part 39 locating in a complementary frustoconical part of the cavity 37. The frustoconical part 39 is extended by a tubular cylindrical end part 40. A channel 41 passes axially through the connector 36. The flexible conduit section 20 is forced axially over the tubular end part 40 until it stretches to cover at least part of the frustoconcal part 39. The connector 36 is then screwed into the cavity 37, the expanded wall of the section 20 providing a seal as it is compressed between the aforementioned two frustoconical parts. The connector 36 is also interchangeable with others differing in terms of the diameter of the channel 41, so as to match the chosen flexible conduit section diameter.

A removable and interchangeable nozzle 41 is provided in the vicinity of the spraying orifice 14, comprising an axial passage 42 adapted to receive the other end of the flexible conduit section 20. This nozzle has a threaded outside part and is screwed into the threaded end of the casing. It bears against a transverse inside wall 44 of the latter, through the intermediary of an annular gasket 45 of flexible and deformable material (foam rubber, for example) which by deforming secures the flexible conduit section into the nozzle, seals the assembly and damps vibrations transmitted by said section to the casing. Such vibrations are further damped by a block 46 of similar flexible material forming part of the handle 15, near where this joins the casing 12. Naturally enough, the connection arrangement at the rear of the casing may be combined with the arrangement of FIG. 3 where the end of the flexible conduit section 20 is left free to move. Likewise, the principle of the damper block in the handle is usable in the other embodiments.

There is claimed:

1. An apparatus for spraying a powder coating comprising a closed flexible hose, means for circulating a mixture of said powder and a gas in said hose, said hose residing on a longitudinal axis between a storage tank and a spray orifice, an enclosure surrounding a section of said hose, and oscillating means for imparting a substantial orbital circular motion to said section of said hose around said longitudinal axis, upstream of and adjacent to said orifice, said oscillating means comprising a vibrator fixed to said section of hose and free to move inside said enclosure.

2. The apparatus for spraying a powder coating according to claim 1, wherein said section of said hose is immobilized at two points inside said enclosure, one of which is in the vicinity of said orifice.

3. The apparatus for spraying a powder coating according to claim 1, wherein said orifice has at least one dimension greater than the diameter of said section of said hose, said hose being immobilized at only one point inside said enclosure, and one end of said hose being free to move in the vicinity of said orifice.

4. The apparatus for spraying a powder coating according to claim 1, wherein said orifice has a removable nozzle comprising a passage adapted to receive one end of said section of said hose.

5. The apparatus for spraying a powder coating according to claim 4, wherein said enclosure has a transverse internal wall and further comprising an annular gasket of flexible and deformable material through which said nozzle is adapted to bear on said transverse internal wall, said gasket sealing, securing and damping vibration of said sections of said hose.

6. The apparatus for spraying a powder coating according to claim 1, comprising a rear wall, a removable connector fixed to said rear wall and a channel in said connector to which the corresponding end of said section of said hose is coupled.

7. The apparatus for spraying a powder coating according to claim 1, comprising a handle having at least one part made of a flexible material to damp vibration due to the movement of said section of said flexible hose.

8. The apparatus for spraying a powder coating according to claim 1 wherein said enclosure comprises a casing of a body of a spray gun.

9. An apparatus for spraying a powder coating comprising:

(a) a closed flexible hose;

(b) means for circulating a mixture of said powder and a gas in said hose, said hose residing on a longitudinal axis between a storage tank and a spray orifice;

(c) an enclosure surrounding a section of said hose; and (d) a vibrator for imparting a substantial orbital circular motion to said section of said hose around said longitudinal axis, upstream of and adjacent to said orifice, said vibrator being fixed to said section of said hose and being free to move inside said enclosure, and comprising:

(i) an annular cage surrounding and fixed to said section of said hose;

(ii) a ball movable within said cage; and (iii) a flexible conduit for discharging air tangentially into said annular cage to move said ball in said cage, and for circularly oscillating said cage and said hose.

10. An apparatus for spraying a powder coating comprising:

(a) a closed flexible hose;

(b) means for circulating a mixture of said powder and a gas in said hose, said hose residing on a longitudinal axis between a storage tank and a spray orifice;

(c) an enclosure surrounding a section of said hose; and (d) means for imparting a substantial orbital circular motion to said section of said hose around said longitudinal axis, upstream of and adjacent to said orifice, said means comprising:

(i) an annular body attached to an inside wall of said enclosure, said annular body being coaxial with said hose and having an inside diameter greater than the diameter of said hose, said hose passing through said annular body, said annular body defining an annular cavity and being provided with a plurality of holes connecting said annular cavity and the interior of said annular body; and (ii) injecting means for injecting air into said annular cavity and said holes, said holes and said section of said hose being aligned such that air injected by said injecting means enters said holes tangentially to said section of said hose, and directly imparts said substantial orbital circular motion to said section of said hose.

11. The apparatus for spraying a powder coating according to claim 9, wherein said enclosure comprises holes disposed circumferentially and helically in the vicinity of said orifice to eject the compressed air injected into said cage in such a way as to generate a swirling jet of air to the rear of said orifice.

12. The apparatus for spraying a powder coating according to claim 10, wherein said enclosure comprises holes disposed circumferentially and helically in the vicinity of said orifice to eject the compressed air injected into said annular cavity in such a way as to generate a swirling jet of air to the rear of said orifice.

13. The apparatus for spraying a powder coating according to claim 10, wherein said orifice has a removable nozzle comprising a passage adapted to receive one end of said section of said hose.

14. The apparatus for spraying a powder coating according to claim 13, wherein said enclosure has a transverse internal wall and further comprising an annular gasket of flexible and deformable material through which said nozzle is adapted to bear on said transverse internal wall, said gasket sealing, securing and damping vibration of said section of said hose.

15. The apparatus for spraying a powder coating according to claim 10, comprising a rear wall, a removable connector fixed to said rear wall and a channel in said connector to which the corresponding end of said section of said hose is coupled.

16. The apparatus for spraying a powder coating according to claim 10, comprising a handle having at least one part made of a flexible material to damp vibration due to the movement of said section of said flexible hose.

* * * * *